United States Patent [19]

Kuhn et al.

[11] Patent Number: 4,634,505

[45] Date of Patent: Jan. 6, 1987

[54] PROCESS AND BATH FOR THE ELECTROLYTIC DEPOSITION OF GOLD-TIN ALLOY COATINGS

[75] Inventors: Werner Kuhn, Rodenbach; Wolfgang Zilske, Hanau, both of Fed. Rep. of Germany

[73] Assignee: Degussa AG, Frankfurt, Fed. Rep. of Germany

[21] Appl. No.: 833,228

[22] Filed: Feb. 26, 1986

[30] Foreign Application Priority Data

Mar. 15, 1985 [DE] Fed. Rep. of Germany ..... 3509367

[51] Int. Cl.[4] ..... C25D 3/62

[52] U.S. Cl. ..... 204/44.3

[58] Field of Search ..... 204/44.3, 47.5

[56] References Cited

U.S. PATENT DOCUMENTS

| | | | |
|---|---|---|---|
| 3,475,290 | 10/1969 | Yamamura et al. | 204/44.3 |
| 4,013,523 | 3/1977 | Stevens et al. | 204/44.3 |
| 4,069,113 | 1/1978 | Crossley et al. | 204/44.3 |
| 4,391,679 | 7/1983 | Zilske et al. | 204/44.3 |

*Primary Examiner*—G. L. Kaplan

*Attorney, Agent, or Firm*—Cushman, Darby & Cushman

[57] ABSTRACT

To produce electrolytic deposition of glossy gold/tin alloys there are employed baths having a pH below 3 which contain 1 to 20 g/l gold in the form of tetracyanoaurate (III), 0.1 to 10 g/l tin, an acid and a conducting salt, whereby the tin is in the form of a tin (IV)-oxalato complex.

19 Claims, No Drawings

PROCESS AND BATH FOR THE ELECTROLYTIC DEPOSITION OF GOLD-TIN ALLOY COATINGS

BACKGROUND OF THE INVENTION

The invention is directed to a bath for the electrolytic (galvanic) deposition of gold/tin alloy coatings at a pH below 3 consisting of (or consisting essentially of) 1 to 20 g/l gold in the form of alkali (e.g., sodium or potassium) and/or ammonium tetracyanoaurate (III), 0.1 to 10 g/l tin in the form of a water soluble tin salt, in a given case 0.005 to 1 g/l of an additional alloying metal in the form of a water soluble salt, an acid and a buffer or conducting salt.

The electrolytic codeposition of tin from gold baths is of interest for decorative and industrial uses. In the decorative industry, gold/tin alloy baths are employed for the production of gold colored coatings, above all white gold coatings, and in electrotechnology the good corrosion resistance and solderability of the tin in combination with gold offers advantages compared to other alloy coatings.

The common deposition of tin and gold is possible from alkaline and acid baths. In Kersten U.S. Pat. No. 1,905,105 there is described an alkaline electrolyte which contains potassium dicyanoaurate (I) and tin as potassium hydroxystannate (IV). However, gold/tin alloy coating are not deposited from baths of this type in glossy metallic form.

Tin in combination with gold can only be deposited from weakly acid baths at pH from 3.5 to 6 if the tin is divalent. The electrolyte thereby contains the gold in the form of potassium dicyanoaurate I, $KAu(CN)_2$. From German OS No. 1960047 and German AS No. 2523510 there are known such electrolytes. These baths are definitely not stable since the divalent tin is relatively easily oxidized to the tetravalent state, which under the stated conditions no longer will codeposit. Even protective materials such as complex formers, sulfonic acids, or soluble tin anodes cannot sufficiently prevent the oxidation.

There is known from German OS No. 2658003 and German Pat. No. 3012999 (and related Zilske U.S. Pat. No. 4,391,679), the codeposition of tin from strongly acid gold electrolytes at pH below 3, which contain the gold in the form of tetracyanoaurate (III) complexes, $Au(CN)^-_4$. In these baths, the tin is deposited from the divalent and the tetravalent oxidation stage.

In German OS No. 2658003 there is described an electrolytic bath which contains 1 to 30 g/l gold as Gold (III)-cyanide complex, whereby to establish the pH and to stabilize the complex there are used hydrohalic acids which lead to considerable corrosion damage to the electrolytic plants. Besides during the electrolysis toxic halogen is developed which under the stated operating conditions escapes in gaseous form.

SUMMARY OF THE INVENTION

Therefore, it was the task of the present invention to develop a bath for the electrolytic deposition of gold/-tin alloy coatings, e.g., on base metals, at a pH below 3 consisting of (or consisting essentially of) 1 to 20 g/l gold in the form of alkali (e.g., sodium or potassium) or ammonium tetracyanoaurate (III), 0.1 to 10 g/l tin in the form of a water soluble tin salt, in a given case with 0.005 to 1 g/l of an additional alloying metal in the form of a water soluble salt, an acid and a buffer or conducting salt which contains the tin as a stable complex salt of oxidation state IV, is halogen free and yields glossy alloy coatings.

This task is solved according to the invention by having the bath contain the tin in the form of a tin (IV)-oxalato complex.

Preferably, it contains the complex in the form of potassium oxalatostannate (IV). There can also be used, for example, sodium oxalatostannate (IV). Besides there can also be employed, for example, oxalatotin (IV) acid. Furthermore, it has proven advantageous if there is used as buffer or conducting salt oxalic acid or oxalic acid and ammonium sulfate. Preferably, there is employed 10 to 50 g/l of oxalic acid or a mixture of 10 to 50 g/l of oxalic acid and 10 to 100 g/l of ammonium sulfate.

The bath can contain additionally 0.005 to 1 g/l of an additional alloying elemental in the form of a water soluble nickel or cobalt salt, e.g., the sulfate. Advantageously, the pH of the bath is adjusted to 0.5 to 2.5 with sulfuric acid or oxalic acid.

The bath is normally employed at a temperature between 20° and 60° C., preferably at 40° to 55° C., and a current density of 0.2 to 5 A/dm$^2$, preferably 1 to 4 A/dm$^2$. Oxalatotin (IV) acid is produced, e.g., by dissolving tin in oxalic acid with addition of hydrogen peroxide, potassium oxalatostannate (IV) by reaction of tin (IV) chloride with potassium oxalate.

By the use of tin, the valence state 4 and bound in a complex the bath is stable to oxidation. Also, there is no separation of stannic acid.

Unexpectedly, these gold/tin alloy baths with oxalate complexes yield glossy coatings without special gloss additives such as salts of semi-metals, e.g., selenium or tellurium or organic compounds, over a broad range of current densities with high current yields of about 90%.

By the additional codeposition of cobalt or nickel the color and the technological properties, such as hardness and mechanical abrasion resistance, of the coating can be influenced. The current yield then drops to a value of 40 to 50%. Unexpectedly, there is also a very low content of non-metallic impurities in the coatings. With less than 0.1%, it is far below that of comparable gold alloy coatings. Besides the coatings in spite of high hardness ($HV_{0.015}$ about 230) are very ductile. The elongation at break measured on 10 μm thick coatings on a copper film is about 20% of the order of magnitude of the coatings from fine gold.

The composition can consist essentially of or consist of the stated materials.

Unless otherwise indicated, all parts and percentages are by weight.

The invention will be explained in more detail in connection with the following examples.

DETAILED DESCRIPTION

Example 1

There was produced an electrolytic gold/tin bath by dissolving the following components:

30 grams of oxalic acid and 50 grams of ammonium sulfate were dissolved in about 900 ml of water. Subsequently, there were added 1.5 grams of potassium oxalatostannate (IV) and 13.8 grams of potassium tetracyanoaurate (III). Then the pH was adjusted to 0.6 with sulfuric acid and the bath volume filled up to 1 liter.

An about 3.5 μm thick glossy gold alloy coating was then deposited on a cathode made of polished and bright nickel plated copper in the bath heated to 55° C. at 2 A/dm$^2$ in 10 minutes. The coating had a color tone about 2N according to DIN 8238 (German Industrial Standard 8238). The tin analysis gave a content of 0.74%. After dissolving the copper base in nitric acid 1:3, there remained a break resistant gold film.

Example 2

According to Example 1, there was employed a bath made of the following components:

| | |
|---|---|
| oxalic acid | 50 g/l |
| tin as oxalato tin (IV) acid | 2 g/l |
| potassium tetracyanoaurate (III) | 20.7 g/l |

The pH was adjusted to 1.0 with sulfuric acid. A 1.5 μm thick, glossy gold coating which contained 0.4% tin was deposited on a bright nickel plated cathode made of polished copper sheet in the bath heated to 40° C. and at a current density of 1 A/dm$^2$ in 10 minutes.

Example 3

Corresponding to Example 1, there was employed a bath made of the following components:

| | |
|---|---|
| oxalic acid | 50 g/l |
| ammonium sulfate | 50 g/l |
| tin as potassium oxalato stannate (IV) | 1 g/l |
| potassium tetracyanoaurate (III) | 13.8 g/l |

Additionally, there was dissolved in the bath 0.1 g/l of cobalt in the form of cobalt sulfate. The pH was adjusted to 0.8 with sulfuric acid.

An about 3 μm thick glossy gold coating with a color tone between 2 and 3N deposited on a bright nickel plated cathode made of a polished brass sheet at a bath temperature of 55° C. and a current density of 3 A/dm$^2$ in 10 minutes. It contained 0.98% tin and 0.3% cobalt.

The baths in all cases are stable over a long time.

The entire disclosure of German priority application No. P3509367.6 is hereby incorporated by reference.

What is claimed is:

1. A bath suitable for the electrolytic deposition of gold/tin alloy coatings at a pH below 3 consisting essentially of (a) water, (b) 1 to 20 g/l gold in the form of at least one member of the group consisting of alkali and ammonium tetracyanoaurate (III), (c) 0.1 to 10 g/l tin in the form of tin (IV)-oxalato complex, (d) an acid, (e) a buffer or conducting salt or (a), (b), (c), (d), (e), and (f) 0.005 to 1 g/l of an additional alloying metal.

2. A bath according to claim 1 consisting of (a), (b), (c), (d), and (e) or (a), (b), (c), (d), (e), and (f).

3. A bath according to claim 2 containing as the conducting and buffer salt oxalic acid or a mixture of oxalic acid and ammonium sulfate.

4. A bath according to claim 3 containing 10 to 50 g/l oxalic acid or both 10 to 50 g/l oxalic acid and 10 to 100 g/l ammonium sulfate.

5. A bath according to claim 4 containing 0.005 to 1 g/l of cobalt or nickel in the form of a water soluble salt.

6. A bath according to claim 3 containing 0.005 to 1 g/l of cobalt or nickel in the form of a water soluble salt.

7. A bath according to claim 1 free of additional alloying element (f).

8. A bath according to claim 1 free of halide ions.

9. A bath according to claim 1 wherein the tin complex is in the form of potassium oxalatostannate (IV).

10. A bath according to claim 9 containing 0.005 to 1 g/l of cobalt or nickel in the form of a water soluble salt.

11. A bath according to claim 1 containing as the conducting and buffer salt oxalic acid or a mixture of oxalic acid and ammonium sulfate.

12. A bath accoarding to claim 11 containing 10 to 50 g/l oxalic acid or both 10 to 50 g/l oxalic acid and 10 to 100 g/l ammonium sulfate.

13. A bath according to claim 12 containing 0.005 to 1 g/l of cobalt or nickel in the form of a water soluble salt.

14. A bath according to claim 11 containing 0.005 to 1 g/l of cobalt or nickel in the form of a water soluble salt.

15. A bath according to claim 1 containing 0.005 to 1 g/l of cobalt or nickel in the form of a water soluble salt.

16. A bath according to claim 1 having a pH of 0.5 to 2.5 and containing sulfuric acid or oxalic acid to maintain the pH.

17. A method comprising electrodepositing a coating of a gold-tin alloy of claim 1 on a base metal.

18. A method comprising electrodepositing a coating of a gold-tin alloy of claim 8 on a base metal.

19. A method comprising electrodepositing a coating of a gold-tin alloy of claim 9 on a base metal.

* * * * *